US010344501B2

(12) United States Patent
Chang

(10) Patent No.: US 10,344,501 B2
(45) Date of Patent: Jul. 9, 2019

(54) ELECTRONIC DEADBOLT LOCK

(71) Applicant: PAMEX INC., Chino, CA (US)

(72) Inventor: Wei-Shiun Chang, Taipei (TW)

(73) Assignee: PAMEX INC., Chino, CA (US)

( * ) Notice: Subject to any disclaimer, the term of this patent is extended or adjusted under 35 U.S.C. 154(b) by 15 days.

(21) Appl. No.: 15/670,011

(22) Filed: Aug. 7, 2017

(65) Prior Publication Data

US 2019/0040655 A1 Feb. 7, 2019

(51) Int. Cl.

| | |
|---|---|
| ***E05B 47/06*** | (2006.01) |
| ***E05B 47/00*** | (2006.01) |
| ***E05B 45/06*** | (2006.01) |

(52) U.S. Cl.

CPC ..... *E05B 47/0657* (2013.01); *E05B 45/06* (2013.01); *E05B 47/0603* (2013.01); *E05B 47/0673* (2013.01); *E05B 47/0012* (2013.01); *E05B 2045/064* (2013.01); *E05B 2047/002* (2013.01)

(58) Field of Classification Search

CPC ..... E05B 47/0657; E05B 47/0012; E05B 47/0603; E05B 45/06; E05B 2045/064; E05B 2047/002; E05B 47/0673

USPC ..... 70/423–428, 455, 379 R, 379 A, 380, 70/277, DIG. 42, DIG. 62, 278.1, 278.2, 70/278.3, 278.7, 279.1, 280–283, 283.1; 292/142, 144

See application file for complete search history.

(56) References Cited

U.S. PATENT DOCUMENTS

| | | | | | |
|---|---|---|---|---|---|
| 861,421 | A | * | 7/1907 | Young | |
| 1,459,290 | A | * | 6/1923 | Habenicht | E05B 45/02 292/341.15 |
| 1,698,201 | A | * | 1/1929 | Pietrie | E05B 67/24 70/168 |
| 3,947,060 | A | * | 3/1976 | Zimmer | E05B 47/0012 292/142 |
| 4,300,374 | A | * | 11/1981 | Mullich | E05B 11/00 70/134 |
| 4,369,642 | A | * | 1/1983 | Grell | E05B 11/00 70/380 |
| 4,576,026 | A | * | 3/1986 | Kurt | E05B 17/04 70/380 |
| 4,633,687 | A | * | 1/1987 | Fane | E05B 47/0012 70/276 |
| 4,709,566 | A | * | 12/1987 | Wildenradt | E05B 13/004 70/129 |

(Continued)

FOREIGN PATENT DOCUMENTS

CN 203308229 U 11/2013

*Primary Examiner* — Lloyd A Gall
(74) *Attorney, Agent, or Firm* — Schmeiser, Olsen & Watts, LLP

(57) ABSTRACT

An electronic deadbolt lock which includes a housing; an electronic recognition device disposed on the housing; a turnpiece pivotally mounted on the housing and connected to a deadbolt; a key operating mechanism disposed on the housing and connected to the deadbolt, wherein the deadbolt moves as a result of rotation of one of the turnpiece and the key operating mechanism; and a braking mechanism controlled by the electronic recognition device, wherein the braking mechanism normally applies a brake to the turnpiece to prevent the turnpiece from being rotated, and it is only when a user passes verification by the electronic recognition device that the turnpiece can be rotated by the user.

14 Claims, 6 Drawing Sheets

(56) References Cited

U.S. PATENT DOCUMENTS

| | | | | | |
|---|---|---|---|---|---|
| 5,072,976 | A * | 12/1991 | Meszaros | E05B 13/004 | 292/150 |
| 5,437,174 | A * | 8/1995 | Aydin | E05B 47/0012 | 70/150 |
| 5,537,848 | A * | 7/1996 | Grzanka | E05B 81/16 | 292/201 |
| 5,715,715 | A * | 2/1998 | Nunez | E05B 47/0012 | 292/144 |
| 6,725,693 | B2 * | 4/2004 | Yu | E05B 47/068 | 292/144 |
| 6,851,291 | B2 * | 2/2005 | Nunez | E05B 47/0673 | 70/150 |
| 6,865,916 | B2 * | 3/2005 | Goldman | E05B 47/0615 | 292/DIG. 27 |
| 7,647,797 | B1 * | 1/2010 | Viso Cabrera | E05B 47/0012 | 292/144 |
| 7,768,378 | B2 * | 8/2010 | Hill | E05B 17/2088 | 340/5.28 |
| 7,870,770 | B2 * | 1/2011 | Blanch | E05B 13/004 | 292/169.15 |
| 8,375,753 | B2 * | 2/2013 | Goldman | E05B 47/0603 | 70/277 |
| 2006/0201215 | A1 * | 9/2006 | Wolf | E05B 17/147 | 70/423 |
| 2006/0267349 | A1 * | 11/2006 | Garneau | E05B 47/0012 | 292/144 |
| 2010/0000274 | A1 * | 1/2010 | Viso Cabrera | E05B 17/22 | 70/278.7 |
| 2010/0206020 | A1 * | 8/2010 | Chen | B60R 25/02153 | 70/210 |
| 2011/0179836 | A1 * | 7/2011 | Dimig | B60R 25/00 | 70/182 |

* cited by examiner

ELECTRONIC DEADBOLT LOCK

FIELD OF THE INVENTION

The present invention relates to door locks and, more particularly, to an electronic deadbolt lock.

BACKGROUND OF THE INVENTION

Due to technological advancement, electronic sensing devices are in wide use in daily life. For instance, conventional mechanical door locks are being replaced by electronic (sensing) door locks. Electronic door locks have advantages as follows: save users the hassles of carrying any key; and be easier and faster to lock and unlock than conventional mechanical door locks, because electronic door locks are not designed to be manually driven.

In case of a small tolerance between a deadbolt of a conventional mechanical door lock and a hole on a wall, users can manually overcome the resistance generated in the course of insertion of the deadbolt into the hole. By contrast, not designed to be manually driven, a conventional electronic door lock is likely to fail, because its deadbolt cannot be aligned with and thus inserted into the hole on the wall. More importantly, the conventional electronic door lock fails also because of repeated attempts of its deadbolt to force its way into the hole on the wall.

Accordingly, it is imperative to provide an electronic deadbolt lock which keeps advantages of mechanical door locks and advantages of electronic door locks.

SUMMARY OF THE INVENTION

It is an objective of the present invention to provide an electronic deadbolt lock to overcome drawbacks of the prior art, for example, in case of a small tolerance between a deadbolt of an electronic door lock and a hole on a wall, the deadbolt of the electronic door lock cannot be precisely inserted into the hole on the wall.

In order to achieve the above and other objectives, the present invention provides an electronic deadbolt lock, comprising: a housing; an electronic recognition device disposed on the housing; a turnpiece pivotally mounted on the housing and connected to a deadbolt; a key operating mechanism disposed on the housing and connected to the deadbolt, wherein the deadbolt moves as a result of rotation of one of the turnpiece and the key operating mechanism; and a braking mechanism controlled by the electronic recognition device, wherein the braking mechanism normally applies a brake to the turnpiece to prevent the turnpiece from being rotated, and it is only when a user passes verification by the electronic recognition device that the turnpiece can be rotated by the user.

In an embodiment of the present invention, the braking mechanism comprises: at least one gear; a driver for controlling the at least one gear rotating; and a stopping member driven by the at least one gear and adapted to apply a brake to the turnpiece, so as to stop the turnpiece from being rotated, wherein, after the user has passed verification by the electronic recognition device, the driver rotates the at least one gear so that the turnpiece can be rotated by the user as soon as the stopping member is driven to separate from the turnpiece.

In an embodiment of the present invention, the braking mechanism further comprises a pause switch which the stopping member separating from the turnpiece comes into contact with to cause the driver to stop rotating the at least one gear.

In an embodiment of the present invention, the braking mechanism further comprises a first spring connected to the stopping member.

In an embodiment of the present invention, the stopping member is a pin, and the turnpiece has an aperture which the stopping member is inserted into to stop the turnpiece from being rotated and exits to allow the turnpiece to be rotated.

In an embodiment of the present invention, the at least one gear comprises: a first major gear connected to the driver; a first minor gear being coaxial with the first major gear and fixed to the first major gear; a second major gear meshing with the first minor gear; and a second minor gear being coaxial with the second major gear and driving the stopping member, wherein the second minor gear and the second major gear either rotate synchronously or do not rotate synchronously.

In an embodiment of the present invention, the second minor gear has at least one tooth for driving the stopping member.

In an embodiment of the present invention, the second minor gear has two or four teeth equidistantly spaced along a perimeter of the second minor gear.

In an embodiment of the present invention, the turnpiece comprises: a rotating body connected to the deadbolt; and a rotating cover connecting with and covering the rotating body, wherein the rotating cover and the rotating body either rotate synchronously or do not rotate synchronously.

In an embodiment of the present invention, the key operating mechanism is disposed in the turnpiece, and both the rotating body and the rotating cover rotate relative to the key operating mechanism.

In an embodiment of the present invention, the turnpiece further comprises: a burglary sensing device disposed beside the key operating mechanism, wherein the rotating cover has a lid for demountably covering the burglary sensing device and the key operating mechanism so that the burglary sensing device sends an alert signal as soon as the lid is removed from the rotating cover.

In an embodiment of the present invention, the burglary sensing device comprises a light sensor or a magnetic sensor.

In an embodiment of the present invention, the rotating body has a groove, and the rotating cover has at least one securing hole, with the turnpiece further comprising at least one securing pin movably received in the groove, allowing an end of the at least one securing pin to be inserted into the at least one securing hole.

In an embodiment of the present invention, the electronic deadbolt lock further comprises: a rotating shaft for moving the deadbolt; and an actuating rotation guide for controlling a direction in which the rotating shaft rotates, wherein the actuating rotation guide comprises a braking protrusion portion, and the rotating body comprises a braking bump, allowing the braking protrusion portion to be disposed at an outer edge of the actuating rotation guide and protrude outward.

In an embodiment of the present invention, the rotating body comprises two receiving portions corresponding in position to each other, and the braking bump is demountably received in one of the receiving portions.

In an embodiment of the present invention, the turnpiece comprises a second spring which encloses the rotating body.

A deadbolt of an electronic deadbolt lock of the present invention moves as a result of rotation of the turnpiece or the key operating mechanism, that is, by a user by hand; hence, the present invention effectively overcomes the aforesaid drawback of the prior art—in case of a small tolerance between a deadbolt of a conventional electronic door lock and a hole on a wall, the deadbolt of the electronic door lock cannot be precisely inserted into the hole on the wall. Furthermore, it is only when a user passes verification by the electronic recognition device that the turnpiece can be rotated by the user. Accordingly, the electronic deadbolt lock of the present invention is as convenient as conventional electronic door locks.

DETAILED DESCRIPTION OF THE PREFERRED EMBODIMENTS

Objectives, features, and advantages of the present invention are hereunder illustrated with specific embodiments in conjunction with the accompanying drawings. The present invention may also be implemented and applied by any other different embodiments. Details described herein may also undergo various modifications and changes according to different points of view and applications without departing from the spirit of the present invention. The accompanying diagrams are merely intended to be schematic but are not drawn to scale. Related technical features of the present invention are hereunder illustrated by embodiments. However, the disclosure of the present invention herein is not restrictive of the claims of the present invention.

Figure 1:
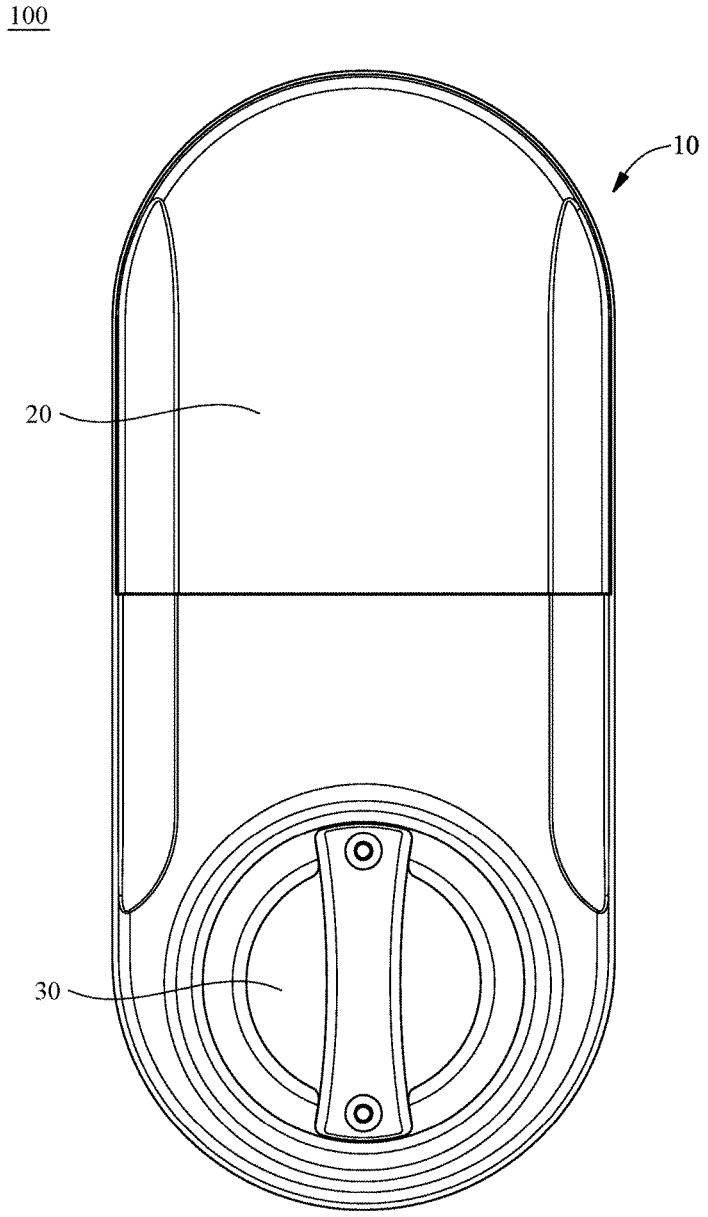
FIG. 1 is a schematic view of an electronic deadbolt lock according to an embodiment of the present invention.
Figure 2:
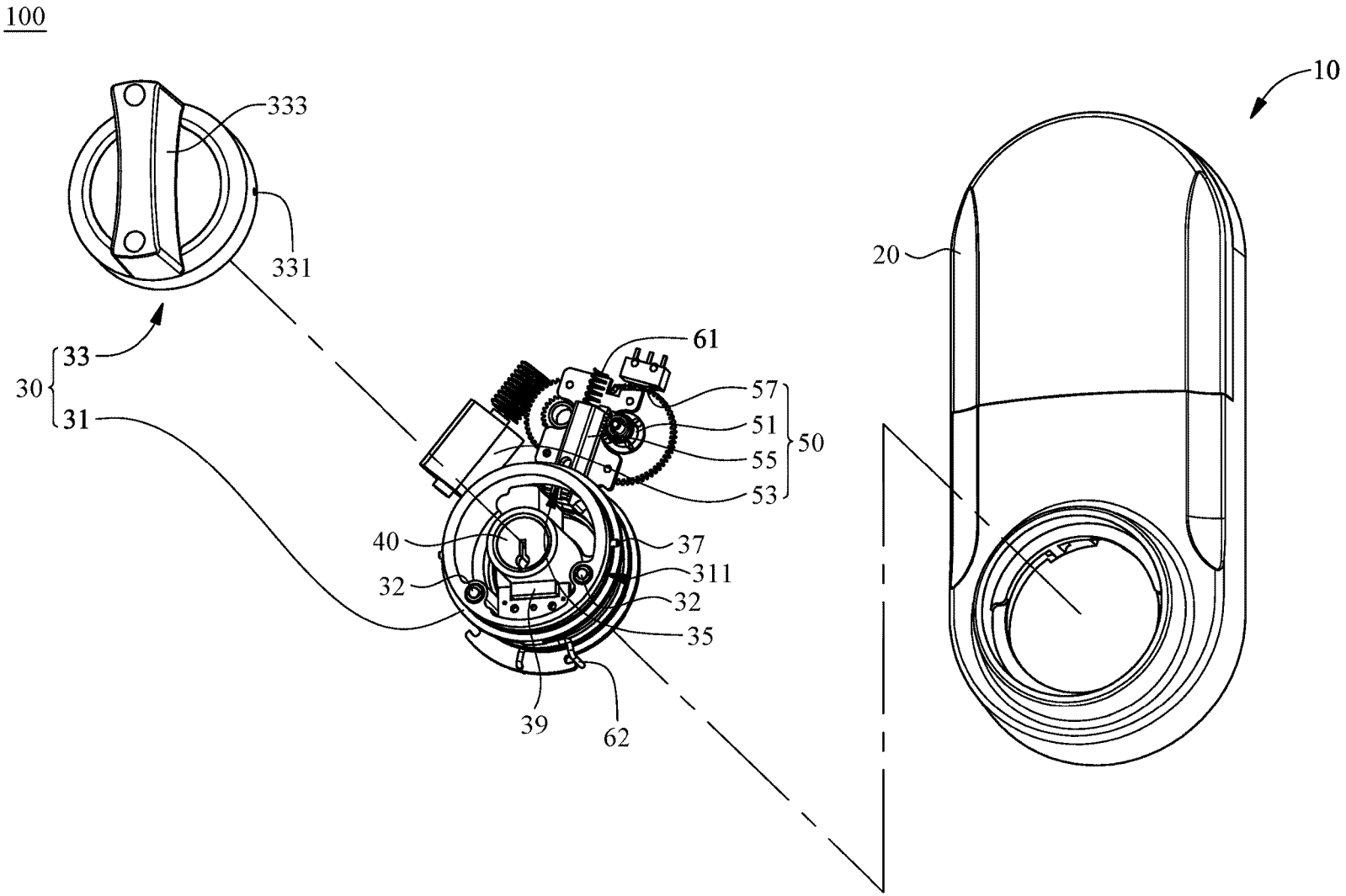
FIG. 2 is an exploded view of the electronic deadbolt lock according to an embodiment of the present invention.

FIG. 1 is a schematic view of an electronic deadbolt lock 100 according to an embodiment of the present invention. FIG. 2 is an exploded view of the electronic deadbolt lock 100 according to an embodiment of the present invention. Referring to FIG. 1, FIG. 2, the electronic deadbolt lock 100 comprises a housing 10, an electronic recognition device 20, a turnpiece 30, a key operating mechanism 40 and a braking mechanism 50. The electronic recognition device 20 is disposed on the housing 10. The turnpiece 30 is pivotally mounted on the housing 10. The key operating mechanism 40 is disposed on the housing. The braking mechanism 50 is controlled by the electronic recognition device 20.

In an embodiment of the present invention, both the turnpiece 30 and the key operating mechanism 40 are connected to a deadbolt (not shown) movable as a result of rotation of the turnpiece 30 or rotation of the key operating mechanism 40. Hence, to operate the electronic deadbolt lock of the present invention, a user must manually rotate the turnpiece 30 or the key operating mechanism 40 in order to move the deadbolt. By contrast, one of the drawbacks of the prior art is that in case of a small tolerance between a deadbolt of a conventional electronic door lock and a hole on a wall, the deadbolt of the electronic door lock cannot be precisely inserted into the hole on the wall.

In an embodiment of the present invention, the braking mechanism 50 normally (in a state shown in FIG. 2) applies a brake to the turnpiece 30 to stop the turnpiece 30 from being rotated. It is only when a user passes verification by the electronic recognition device 20 that the turnpiece 30 can be rotated by the user. Referring to FIG. 2, the braking mechanism 50 comprises at least one gear 51, a driver 53 and a stopping member 55. The driver 53 controls the rotation of the at least one gear 51. The stopping member 55 is driven by the at least one gear 51 and adapted to apply a brake to the turnpiece 30, so as to stop the turnpiece 30 from being rotated by the user.

In an embodiment of the present invention, to rotate the turnpiece 30 and thereby move the deadbolt, a user must pass verification by the electronic recognition device 20. It is only when the user passes verification by the electronic recognition device 20 that the driver 53 can rotate the at least one gear 51. After the user has passed verification by the electronic recognition device 20, the driver 53 exerts a rotational force on the at least one gear 51 and thereby drives the stopping member 55 to separate from the turnpiece 30, thereby allowing the turnpiece 30 to be rotated by the user.

For instance, a user of the electronic deadbolt lock 100 holds a sensor and approaches the electronic recognition device 20 with a view to passing verification by the electronic recognition device 20. The sensor is, for example, a sensing magnetic disk, an infrared remote control device or a smartphone. In a variant embodiment, the electronic recognition device 20 comprises a password or biological recognition module whereby a user directly enters a password or undergoes fingerprint, voiceprint or iris recognition for passing verification. As mentioned before, it is only when a user passes verification by the electronic recognition device 20 that the turnpiece 30 can be rotated by the user. Therefore, the electronic deadbolt lock 100 of the present invention is safe to use.

In an embodiment illustrated by FIG. 2, the stopping member 55 is a pin, and the turnpiece 30 has an aperture 35. The stopping member 55 is inserted into the aperture 35 to prevent the turnpiece 30 from being rotated and exits the aperture 35 to allow the turnpiece 30 to be rotated, but the present invention is not limited thereto. In another embodiment, the stopping member 55 stops, in any other way not described herein, the turnpiece 30 from being rotated so that the aforesaid restraint placed by the stopping member 55 on the turnpiece 30 will be removed only if a user passes verification by the electronic recognition device 20.

In an embodiment, the braking mechanism 50 further comprises a pause switch 57. When the stopping member 55 is driven by the at least one gear 51 to therefore separate from the turnpiece 30 and come into contact with the pause switch 57, the driver 53 stops rotating the at least one gear 51 and thereby stops providing any rotational torque to the at least one gear 51. Upon separation of the stopping member 55 and the turnpiece 30, the pause switch 57 causes the driver 53 to stop operating, thereby precluding a waste of electrical power or damage of the at least one gear 51.

Figure 3:
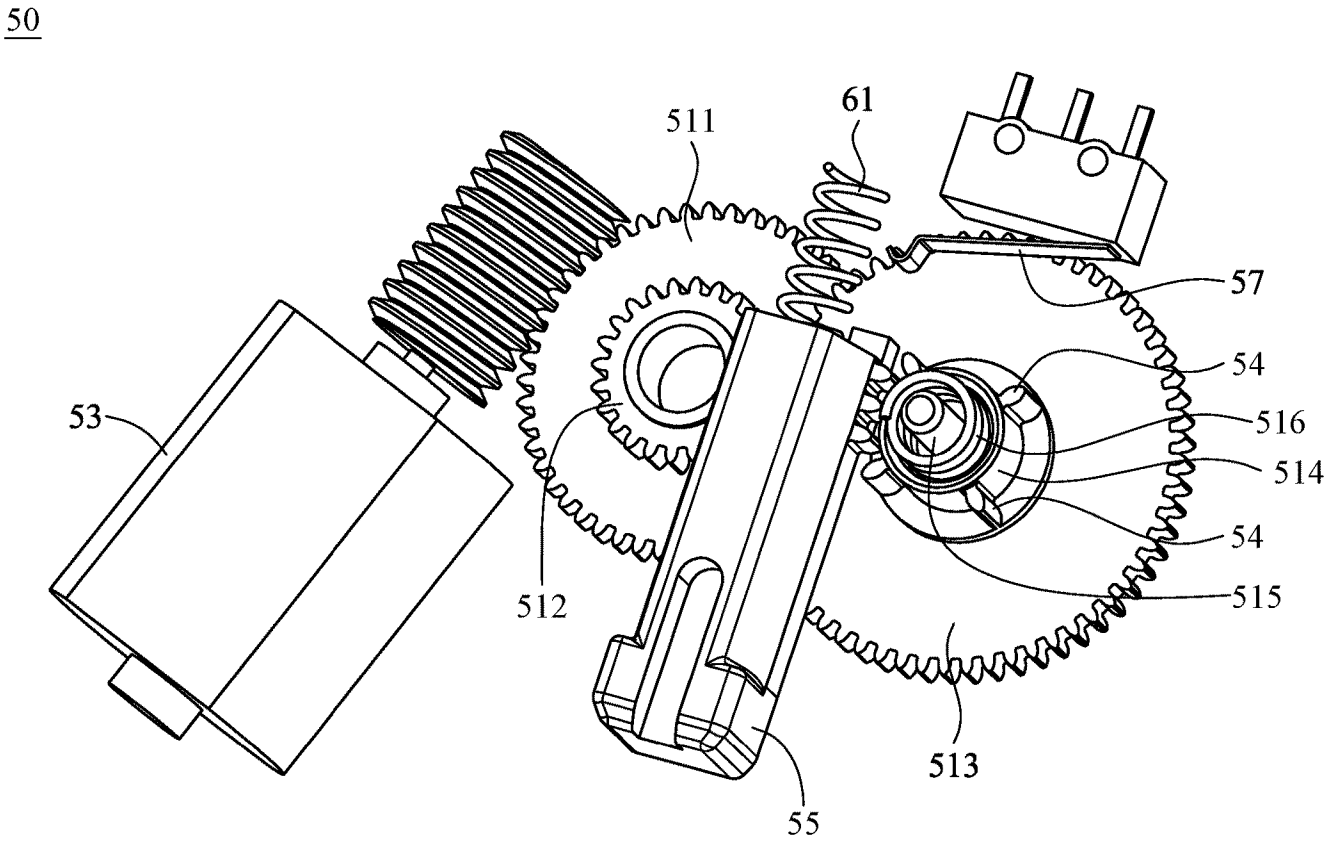
FIG. 3 is a schematic view of a braking mechanism according to an embodiment of the present invention.

FIG. 3 is a schematic view of the braking mechanism 50 according to an embodiment of the present invention. Referring to FIG. 2, FIG. 3, in this embodiment, the at least one gear 51 comprises a first major gear 511, a first minor gear 512, a second major gear 513 and a second minor gear 514. The first major gear 511 is connected to the driver 53. The first minor gear 512 is coaxial with the first major gear 511. The first minor gear 512 is fixed to the first major gear 511.

Hence, the first minor gear 512 and the first major gear 511 rotate synchronously. The second major gear 513 meshes with the first minor gear 512 so that the first minor gear 512 drives the second major gear 513 to rotate. The second minor gear 514 is coaxial with the second major gear 513 and drives the stopping member 55.

Normally, the second minor gear 514 and the second major gear 513 rotate synchronously. In an embodiment of the present invention, with the second minor gear 514 not being fixed to the second major gear 513, the second minor gear 514 and the second major gear 513 either rotate synchronously or do not rotate synchronously. The quantity of, and the way of connecting, the at least one gear 51 of the braking mechanism 50 are adjustable and thus not restrictive of the aforesaid embodiments.

For instance, in an embodiment illustrated by FIG. 2, odds are users might inadvertently exert a force on the turnpiece 30 before subjecting themselves to verification by the electronic recognition device 20. As a result, the stopping member 55 is confined to the aperture 35, and in consequence the second minor gear 514 cannot drive the stopping member 55 to separate from the turnpiece 30. However, after a user has passed verification by the electronic recognition device 20, the driver 53 begins to provide a rotational torque to the gears 51 so that the first major gear 511 and the first minor gear 512 rotate synchronously, thereby allowing the first minor gear 512 to drive the second major gear 513 to rotate. With the second minor gear 514 not being fixed to the second major gear 513, the second minor gear 514 and the second major gear 513 either rotate synchronously or do not rotate synchronously; meanwhile, the second minor gear 514 and the second major gear 513 are disengaged from each other so that the second major gear 513 is idling, thereby preventing a failure of the braking mechanism 50.

In an embodiment, a clutching mechanism is, for example, disposed between the second major gear 513 and the second minor gear 514 so that the second minor gear 514 and the second major gear 513 either rotate synchronously or do not rotate synchronously. Referring to FIG. 2, FIG. 3, a spring 516 is disposed on a bearing 515 of the second minor gear 514 and the second major gear 513 so that the second minor gear 514 is fixed in place under an elastic force exerted by the spring 516.

In an embodiment of the present invention, the second minor gear 514 has at least one tooth 54. The at least one tooth 54 drives the stopping member 55. It is only when the at least one tooth 54 of the second minor gear 514 meshes with the stopping member 55 and rotates that the stopping member 55 is driven to move away from the aperture 35.

In an embodiment, the second minor gear 514 has two or four teeth 54. The teeth 54 are equidistantly spaced along the perimeter of the second minor gear 514. For instance, when the second minor gear 514 has two teeth 54, the teeth 54 is disposed at the perimeter of the second minor gear 514 and located at two ends of a diameter of the second minor gear 514, respectively. Alternatively, as shown in FIG. 3, when the second minor gear 514 has four teeth 54, the teeth 54 are disposed at the perimeter of the second minor gear 514 and angularly spaced apart by 90°.

In an embodiment illustrated with FIG. 2, FIG. 3, the second minor gear 514 has four teeth 54. The braking mechanism 50 further comprises a first spring 61. The first spring 61 is connected to the stopping member 55. The driver 53 automatically resumes operation in a predetermined time period, say, 5 seconds, after the stopping member 55 has come into contact with the pause switch 57 and thereby stopped the driver 53 from providing a rotational torque to the gears 51; hence, the driver 53 stops, after the second minor gear 514 has rotated again to cause separation of all the four teeth 54 from the stopping member 55. At this point in time, the stopping member 55 no longer meshes with any one of the four teeth 54 of the second minor gear 514, and thus the stopping member 55 returns to its initial position under an elastic force exerted by the first spring 61.

The quantity of the teeth 54 of the second minor gear 514 is subject to changes, depending on the size of the second minor gear 514, the distance traveled by the stopping member 55, and how to optimize the rotational torque provided by the driver 53.

Referring to FIG. 2, in an embodiment of the present invention, the turnpiece 30 comprises a rotating body 31 and a rotating cover 33. The rotating cover 33 has a lid 333. The rotating body 31 is connected to the deadbolt. The rotating cover 33 connects with and covers the rotating body 31. The key operating mechanism 40 is disposed in the turnpiece 30. Both the rotating body 31 and the rotating cover 33 rotate relative to the key operating mechanism 40.

In an embodiment of the present invention, the rotating cover 33 and the rotating body 31 either rotate synchronously or do not rotate synchronously. No thief who fails to pass verification by the electronic recognition device 20 is able to rotate the turnpiece 30 by force, because the rotating cover 33 is separate from the rotating body 31 and thus is idling, thereby rendering it impossible to tamper with the stopping member 55.

Referring to FIG. 2, a clutching mechanism 32 is, for example, disposed between the rotating cover 33 and the rotating body 31 so that the rotating cover 33 and the rotating body 31 either rotate synchronously or do not rotate synchronously.

Referring to FIG. 2, in an embodiment, the rotating body 31 has a groove 311, whereas the rotating cover 33 has at least one securing hole 331. The turnpiece 30 further comprises at least one securing pin 37. The at least one securing pin 37 is movably received in the groove 311 of the rotating body 31. One end of the at least one securing pin 37 is inserted into at least one securing hole 331 of the rotating cover 33. Hence, the at least one securing hole 331 corresponds in quantity to the at least one securing pin 37. The at least one securing pin 37, the groove 311 and the at least one securing hole 331 enable the rotating cover 33 to be firmly connected to the rotating body 31 and thus not easily removed even when the rotating cover 33 and the rotating body 31 either rotate synchronously or do not rotate synchronously (for example, when idling).

The turnpiece 30 comprises a second spring 62. The second spring 62 encloses the rotating body 31. After the user has rotated the turnpiece 30, the turnpiece 30 returns to its initial position under an elastic force exerted by the second spring 62, allowing the stopping member 55 to be inserted into the aperture 35 again.

Figure 4:
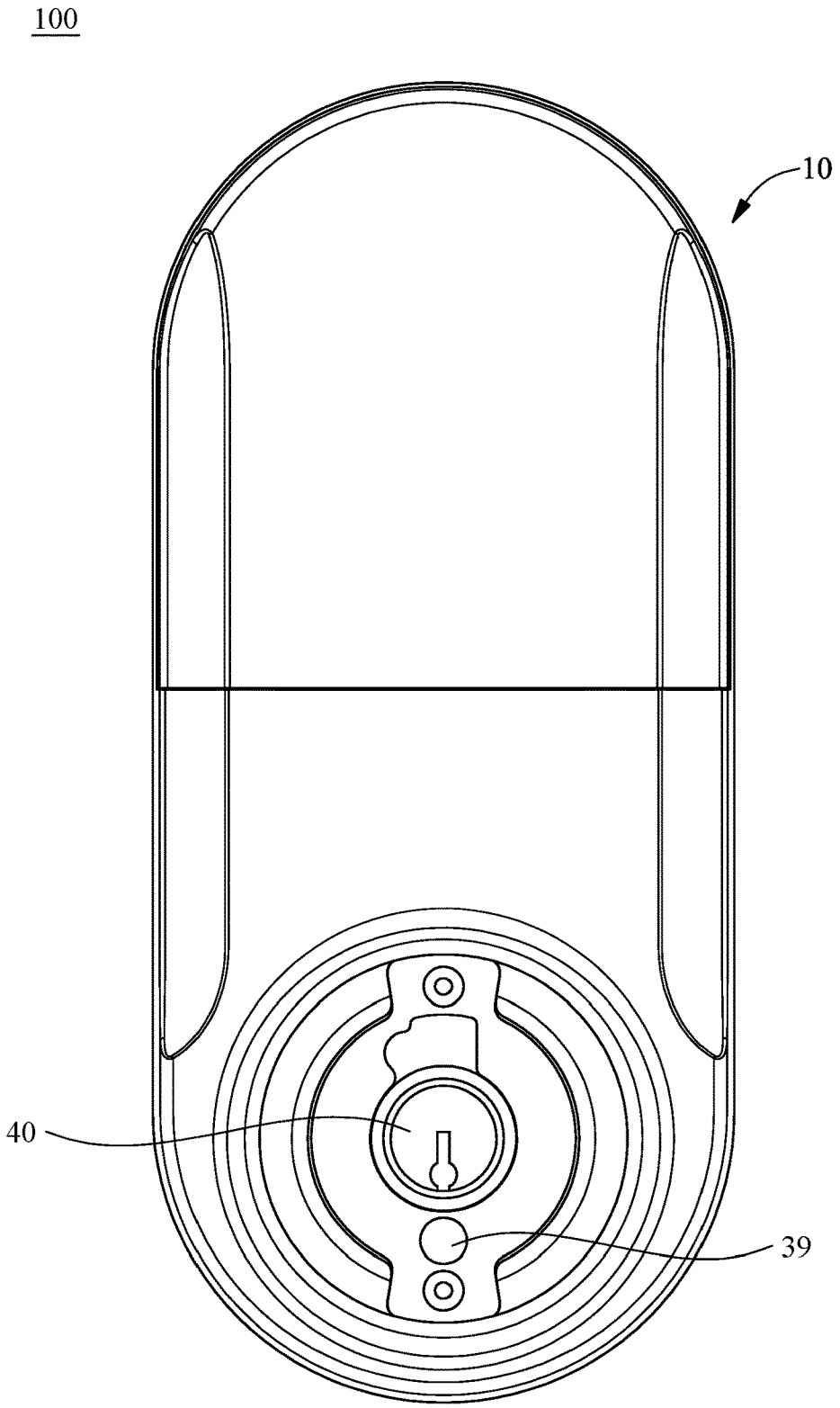
FIG. 4 is a schematic view of the electronic deadbolt lock with a lid (not shown) according to an embodiment of the present invention.

FIG. 4 is a schematic view of the electronic deadbolt lock 100 with the lid 333 (not shown) according to an embodiment of the present invention. Referring to FIG. 2 and FIG. 4, in an embodiment of the present invention, the turnpiece 30 further comprises a burglary sensing device 39. The burglary sensing device 39 is disposed beside the key operating mechanism 40. The lid 333 demountably covers the burglary sensing device 39 and the key operating mechanism 40. The burglary sensing device 39 sends an alert signal as soon as the lid 333 is removed from the rotating cover 33. Different ways of unlocking the electronic deadbolt lock 100 and operating the burglary sensing device 39 are described below.

When power supply is normal, the user of the electronic deadbolt lock 100 holding a sensor can approach the electronic recognition device 20 with a view to passing verification by the electronic recognition device 20, as described above. The sensor is, for example, a sensing magnetic disk, an infrared remote control device or a smartphone. Alternatively, the electronic recognition device 20 comprises a password or biological recognition module whereby the user directly enters a password or undergoes fingerprint, voiceprint or iris recognition with a view to passing verification. After the user has passed verification by the electronic recognition device 20, the stopping member 55 is driven to separate from the turnpiece 30 so that the user can rotate the turnpiece 30 in order to unlock the electronic deadbolt lock 100.

When power supply is abnormal (for example, in case of an outage or when a battery in the electronic deadbolt lock 100 is running out of power), the user removes the lid 333 from the burglary sensing device 39 and the key operating mechanism 40 and inserts a key into the key operating mechanism 40 in order to unlock the electronic deadbolt lock 100. As abnormal power supply always means that the burglary sensing device 39 of the electronic deadbolt lock 100 cannot start, the burglary sensing device 39 does not send any alert signal.

When power supply is normal, a thief cannot insert a universal key into the key operating mechanism 40 to unlock the electronic deadbolt lock 100, unless the thief removes the lid 333 from the rotating cover 33 to expose the key operating mechanism 40. However, the thief's removal of the lid 333 from the rotating cover 33 to expose the key operating mechanism 40 always triggers the burglary sensing device 39 to send an alert signal. The alert signal is, for example, alert light or alert sound, designed to warn residents and passers-by of an ongoing burglary. Furthermore, the burglary sensing device 39 informs the user of the electronic deadbolt lock 100 of an ongoing burglary by a short message service (SMS) or a related cellphone app or directly reports the burglary to a security system.

In an embodiment, the burglary sensing device 39 comprises a light sensor for sensing the removal of the lid 333 from the rotating cover 33 and triggering the burglary mechanism to send an alert signal.

Alternatively, the burglary sensing device 39 comprises a magnetic sensor. The lid 333 connects with and covers the burglary sensing device 39 by magnetic attraction. Hence, the magnetic sensor senses the removal of the lid 333 from the rotating cover 33 and thereby triggers the burglary sensing device 39 to send an alert signal.

Although the aforesaid embodiments are exemplified by the key operating mechanism 40 with a keyhole, the present invention is not limited thereto. In a variant embodiment, the key operating mechanism 40 is replaced by a numeric keypad whereby the user enters a numeric password in order to perform a mechanical unlocking process, wherein any other appropriate mechanical unlocking technique is applicable to the present invention.

Given normal power supply, the user of the electronic deadbolt lock 100 can pass verification by the electronic recognition device 20 and rotate the turnpiece 30 in order to perform an unlocking process but seldom removes the lid 333 from the rotating cover 33. By contrast, thieves can perform an unlocking process only by tampering with the key operating mechanism 40 and removing the lid 333. Therefore, the burglary sensing device 39 not only saves the electronic deadbolt lock 100 the inconvenience of carrying any key, but also greatly reduces the chance that, like conventional mechanical door locks, the electronic deadbolt lock 100 will be unlocked by thieves with a universal key. Furthermore, in case of an outage or when a battery in the electronic deadbolt lock 100 is running out of power, the user may still unlock the electronic deadbolt lock 100 with the key operating mechanism 40 thereof.

Figure 5:
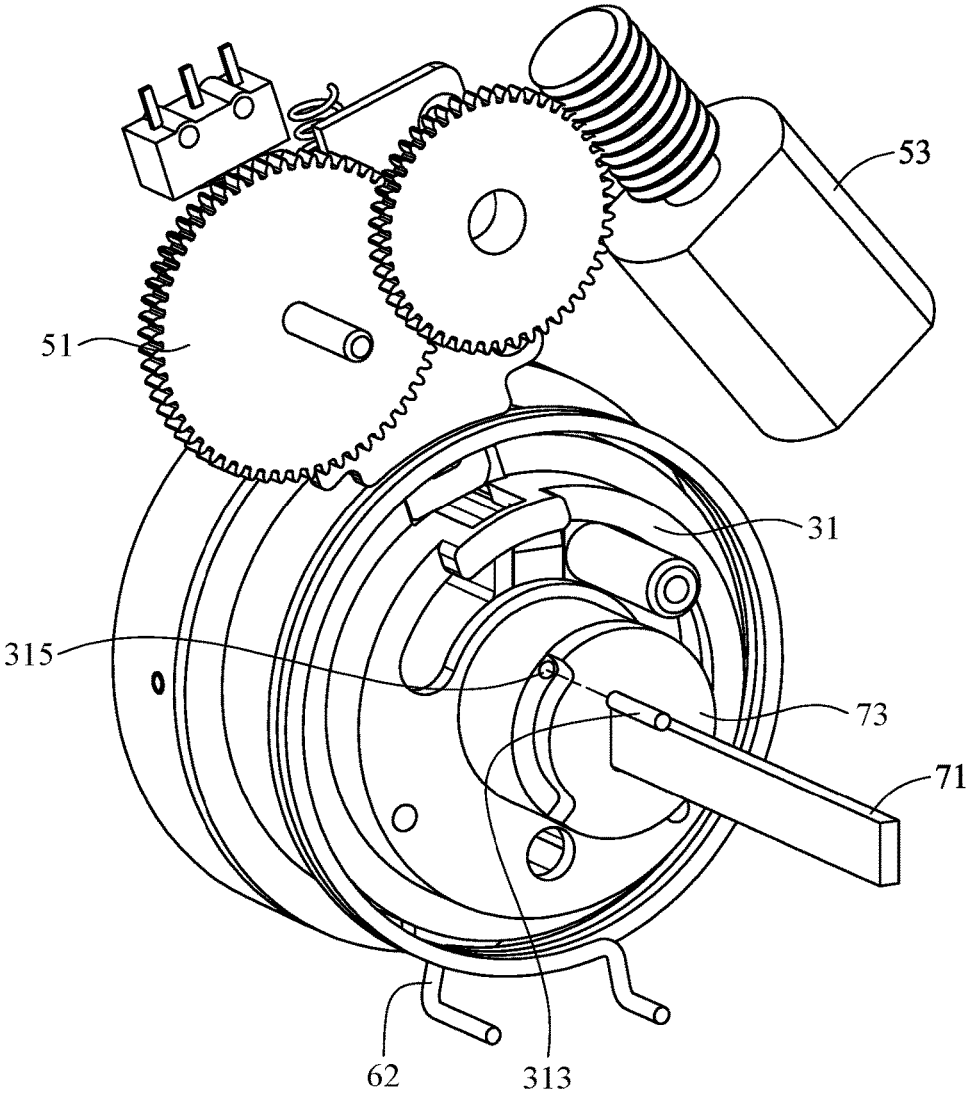
FIG. 5 is a schematic view of the electronic deadbolt lock taken from another view according to an embodiment of the present invention.
Figure 6:
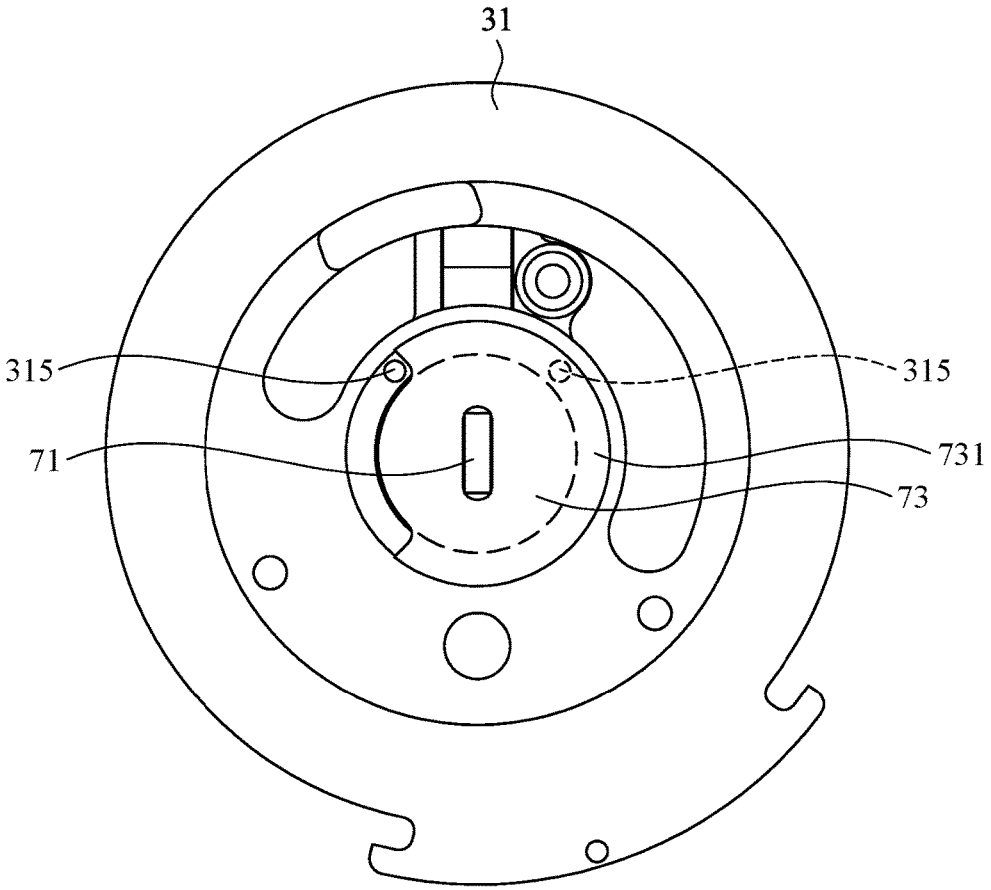
FIG. 6 is a top view of the electronic deadbolt lock according to an embodiment of the present invention.

FIG. 5 is a schematic view of the electronic deadbolt lock 100 taken from another view according to an embodiment of the present invention. Referring to FIG. 5, in an embodiment of the present invention, the electronic deadbolt lock 100 further comprises a rotating shaft 71 and an actuating rotation guide 73. The rotating shaft 71 is for moving the deadbolt so that the user rotates the rotating shaft 71 and moves the deadbolt by rotating the turnpiece 30 or rotating the key operating mechanism 40. The actuating rotation guide 73 controls the direction in which the rotating shaft 71 rotates. FIG. 6 is a top view of the electronic deadbolt lock 100 according to an embodiment of the present invention. Referring to FIG. 6, the actuating rotation guide 73 comprises a braking protrusion portion 731, and the braking protrusion portion 731 is disposed at an outer edge of the actuating rotation guide 73 and protrudes outward.

Referring to FIG. 5 and FIG. 6, the rotating body 31 comprises a braking bump 313. The braking bump 313 of the rotating body 31 can come into contact with the braking protrusion portion 731 of the actuating rotation guide 73 when the user applies a torque under which the turnpiece 30 rotates clockwise (as shown in the diagrams) to thereby drive the actuating rotation guide 73 to rotate clockwise (as shown in the diagrams), thereby rotating the rotating shaft 71. Conversely, if the user applies a torque under which the turnpiece 30 rotates counterclockwise (as shown in the diagrams), neither the actuating rotation guide 73 nor the rotating shaft 71 rotates, because the braking bump 313 of the rotating body 31 is separate from the braking protrusion portion 731 of the actuating rotation guide 73 within a rotation range.

In this embodiment, the rotating body 31 comprises two receiving portions 315. The receiving portions 315 correspond in position to each other (as shown in FIG. 6). The braking bump 313 is demountably received in one of the receiving portions 315. The position of the braking bump 313 and the position of the actuating rotation guide 73 are subject to changes to therefore change the direction in which the rotating shaft 71 of the electronic deadbolt lock 100 rotates.

This embodiment involves removing the braking bump 313, rotating the actuating rotation guide 73 by 180 degrees about the position shown in FIG. 5, FIG. 6, and replacing the braking bump 313 with the receiving portion 315 (i.e., the receiving portion 315 on the right in FIG. 6) covered with the actuating rotation guide 73 in FIG. 5, FIG. 6. If the user applies a torque under which the turnpiece 30 rotates counterclockwise as shown in FIG. 5, FIG. 6, the actuating rotation guide 73 will rotate counterclockwise as shown in the diagrams and thereby will rotate the rotating shaft 71, because the braking bump 313 of the rotating body 31 is in contact with the braking protrusion portion 731 of the actuating rotation guide 73. Conversely, if the user applies a torque under which the turnpiece 30 rotates clockwise as shown in the diagrams, neither the actuating rotation guide 73 nor the rotating shaft 71 will rotate, because the braking bump 313 of the rotating body 31 is separate from the braking protrusion portion 731 of the actuating rotation guide 73 within a rotation range.

Given the aforesaid components, arrangement thereof, and operation thereof, it is feasible to make simple changes to the direction in which the rotating shaft 71 of the electronic deadbolt lock 100 rotates so that the electronic deadbolt lock of the present invention 100 suits both left-handedness and right-handedness as needed. In addition, the components of the electronic deadbolt lock 100 are no different from their conventional counterparts and thus each dispense with the need to perform a unique mold-making process, thereby not only cutting the costs of manufacturing door locks but also enhancing inventory cost control.

In conclusion, a deadbolt of the electronic deadbolt lock of the present invention 100 moves as a result of rotation of the turnpiece 30 or the key operating mechanism 40, that is, by a user by hand; hence, the present invention effectively overcomes the aforesaid drawback of the prior art—in case of a small tolerance between a deadbolt of a conventional electronic door lock and a hole on a wall, the deadbolt of the electronic door lock cannot be precisely inserted into the hole on the wall. Furthermore, it is only when a user passes verification by the electronic recognition device 20 that the turnpiece 30 can be rotated by the user; hence, the electronic deadbolt lock 100 of the present invention is safe to use.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

The invention claimed is:

1. An electronic deadbolt lock, comprising:

a housing;

an electronic recognition device disposed on the housing;

a turnpiece pivotally mounted on the housing and connected to a deadbolt;

a key operating mechanism disposed on the housing and connected to the deadbolt, wherein the deadbolt moves as a result of rotation of one of the turnpiece and the key operating mechanism; and a braking mechanism controlled by the electronic recognition device, wherein the braking mechanism normally applies a brake to the turnpiece to prevent the turnpiece from being rotated, and it is only when a user passes verification by the electronic recognition device that the turnpiece can be rotated by the user;

wherein the turnpiece comprises:

a rotating body connected to the deadbolt; and a rotating cover connecting with and covering the rotating body, wherein the rotating cover and the rotating body either rotate synchronously or do not rotate synchronously;

wherein the key operating mechanism is disposed in the turnpiece, and both the rotating body and the rotating cover rotate relative to the key operating mechanism.

2. The electronic deadbolt lock of claim 1, wherein the braking mechanism comprises:

at least one gear;

a driver for controlling the at least one gear rotating; and a stopping member driven by the at least one gear and adapted to apply a brake to the turnpiece, so as to stop the turnpiece from being rotated, wherein, after the user has passed verification by the electronic recognition device, the driver rotates the at least one gear so that the turnpiece can be rotated by the user as soon as the stopping member is driven to separate from the turnpiece.

3. The electronic deadbolt lock of claim 2, wherein the braking mechanism further comprises a pause switch which the stopping member separating from the turnpiece comes into contact with to cause the driver to stop rotating the at least one gear.

4. The electronic deadbolt lock of claim 2, wherein the braking mechanism further comprises a first spring connected to the stopping member.

5. The electronic deadbolt lock of claim 2, wherein the stopping member is a pin, and the turnpiece has an aperture which the stopping member is inserted into to stop the turnpiece from being rotated and exits to allow the turnpiece to be rotated.

6. The electronic deadbolt lock of claim 2, wherein the at least one gear comprises:

a first major gear connected to the driver;

a first minor gear being coaxial with the first major gear and fixed to the first major gear;

a second major gear meshing with the first minor gear; and a second minor gear being coaxial with the second major gear and driving the stopping member, wherein the second minor gear and the second major gear either rotate synchronously or do not rotate synchronously.

7. The electronic deadbolt lock of claim 6, wherein the second minor gear has at least one tooth for driving the stopping member.

8. The electronic deadbolt lock of claim 6, wherein the second minor gear has two or four teeth equidistantly spaced along a perimeter of the second minor gear.

9. The electronic deadbolt lock of claim 1, wherein the turnpiece further comprises:

a burglary sensing device disposed beside the key operating mechanism, wherein the rotating cover has a lid for demountably covering the burglary sensing device and the key operating mechanism so that the burglary sensing device sends an alert signal as soon as the lid is removed from the rotating cover.

10. The electronic deadbolt lock of claim 9, wherein the burglary sensing device comprises one of a light sensor and a magnetic sensor.

11. The electronic deadbolt lock of claim 1, wherein the rotating body has a groove, and the rotating cover has at least one securing hole, with the turnpiece further comprising at least one securing pin movably received in the groove, allowing an end of the at least one securing pin to be inserted into the at least one securing hole.

12. The electronic deadbolt lock of claim 1, further comprising:

a rotating shaft for moving the deadbolt; and an actuating rotation guide for controlling a direction in which the rotating shaft rotates, wherein the actuating rotation guide comprises a braking protrusion portion, and the rotating body comprises a braking bump, allowing the braking protrusion portion to be disposed at an outer edge of the actuating rotation guide and protrude outward.

13. The electronic deadbolt lock of claim 12, wherein the rotating body comprises two receiving portions corresponding in position to each other, and the braking bump is demountably received in one of the receiving portions.

14. The electronic deadbolt lock of claim 1, wherein the turnpiece comprises a second spring which encloses the rotating body.

* * * * *